US007652682B2

(12) United States Patent
Ushio

(10) Patent No.: US 7,652,682 B2
(45) Date of Patent: Jan. 26, 2010

(54) IMAGE FORMING APPARATUS

(75) Inventor: Yukihide Ushio, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/107,656

(22) Filed: Apr. 22, 2008

(65) Prior Publication Data

US 2008/0267653 A1 Oct. 30, 2008

(30) Foreign Application Priority Data

Apr. 27, 2007 (JP) ..... 2007-119617
Apr. 18, 2008 (JP) ..... 2008-109544

(51) Int. Cl.
*B41J 2/435* (2006.01)
*B41J 2/47* (2006.01)

(52) U.S. Cl. ..... 347/235; 347/250

(58) Field of Classification Search ..... 347/229, 347/234, 235, 248–250; 358/471, 537; 345/213
See application file for complete search history.

(56) References Cited

U.S. PATENT DOCUMENTS 6,304,296 B1 * 10/2001 Yoneno ..... 348/537
6,587,248 B1 7/2003 Gyoten
6,924,796 B1 * 8/2005 Someya et al. ..... 345/213
2007/0206234 A1 * 9/2007 Ozasa et al. ..... 358/471

FOREIGN PATENT DOCUMENTS

JP 01262139 A * 10/1989
JP 08-321952 A 12/1996
JP 2001-119648 A 4/2001
JP 2004-249497 A 9/2004
JP 2006-175646 A 7/2006

* cited by examiner

*Primary Examiner*—Hai C Pham
(74) *Attorney, Agent, or Firm*—Canon U.S.A. Inc., I.P. Division

(57) ABSTRACT

In an image forming apparatus that outputs a reference clock, divides the outputted reference clock based on a set multiple, and generates an image clock based on the division, a width of a synchronization signal that indicates dynamic deviation characteristics is detected, and the multiple is set in accordance with the detected width of the synchronization signal.

8 Claims, 9 Drawing Sheets

IMAGE FORMING APPARATUS

BACKGROUND OF THE INVENTION

1. Field of the Invention

The present invention relates to image forming technology.

2. Description of the Related Art

With a conventional image forming apparatus, such as a laser printer, a digital multifunction peripheral, or the like, that forms images using a laser beam scanning unit, images are formed using processes for increasing resolution, expressing multiple tones, smoothing, and so on, in order to achieve high image quality.

As representative methods for increasing the quality of an image, there are methods, called pulse width modulation (abbreviated hereinafter as "PWM"), luminance modulation, and so on that are performed on the image data, in which the darkness and the like of dots are controlled by controlling the strength (performing strength control) of the amount of light irradiated onto a photosensitive member, on a pixel-by-pixel basis. In recent years, PWM and luminance modulation are being combined in an attempt to further improve the tonal expression of the dots to be formed on a pixel-by-pixel basis (formed-pixel dots). Various developments are being made with respect to tone, image clarity, and the like, by altering the position, center, and so on of the formed-pixel dots. This results in improved, higher image quality.

(Pulse Width Modulation)

With regards to PWM techniques, there is a configuration that uses a reference clock of n times the frequency of an image clock used to define a single pixel (see Japanese Patent Laid-Open No. 8-321952). According to the controller illustrated in FIG. 1 of Japanese Patent Laid-Open No. 8-321952, a pixel pattern for expressing multiple tones is expanded in a look-up table in order to convert inputted multi-tone input image data into multi-tone image data for an image forming apparatus. The data is written into a video band buffer, after which it is set as binary data in serial order of the formed pixels using a parallel-to-serial converter; the resultant is then transferred as image data (VDO) for the image forming apparatus through an image clock (4VCLK) that is inputted sequentially.

At this time, the image clock (4VCLK) is configured as a multi-value clock having a value four times that of a reference clock (VCLK). In other words, 4-bit PWM having multi-valued (4-bit) tone, the 4 bits being realized by dividing a single pixel into 4 parts, is carried out, thereby expressing 16 tones. If, for example, the PWM data is 8-bit data, it is possible to express 256 tones. With PWM, a reference clock that is a multiple of the image clock is necessary, and the resolution and reference clock are in a proportional relationship. Furthermore, a horizontal synchronization signal for synchronizing the phase of each line image, and the synchronization accuracy, are both important factors.

In Japanese Patent Laid-Open No. 8-321952, there are no descriptions regarding the control of the centers of formed-pixel dots; however, it is possible to control the position of dots of equal width formed within a pixel by controlling the formation process for expressing multiple values within a single pixel to widen the pixel from the right side, from the left side, or from the center.

(Luminance Modulation)

Regarding luminance modulation techniques, the potential of a latent image formed on a photosensitive member can be controlled by controlling the strength of the light irradiated onto that photosensitive member. In recent years, it has become possible to carry out such luminance modulation along with PWM control on a formed-pixel dot basis, using high-frequency modulation techniques. Controlling the luminance on a pixel-by-pixel basis, or in other words, controlling the light source on a pixel-by-pixel basis by synchronizing the luminance modulation with PWM in order to further improve tonal expression, has been proposed (see Japanese Patent Laid-Open No. 2001-119648).

When the number of tones is increased in order to improve the tonal expression, the clock frequency also increases. When forming pixel dots of extremely small widths using PWM, there is a limit on the switching response of the light source, which is a laser or the like. As a response to a problem in which a predetermined pulse width for forming pixel dots of extremely small widths cannot be obtained, Japanese Patent Laid-Open No. 2001-119648 discloses a configuration that performs luminance modulation in synchronization with PWM processing. In other words, the technique of Japanese Patent Laid-Open No. 2001-119648 attempts to improve the expression of pixel dots formed on a photosensitive member by making it possible to set the strength of the luminance through luminance modulation at the time of PWM conversion executed on a formed-pixel dot basis. Through this, how smooth the change in the tonal strength is (the gradation) in the image formed on the photosensitive member can be expressed with increased smoothness.

Meanwhile, the capabilities of image forming apparatuses that use optical scanning have reached the level of 2400 dpi (dots per inch) in resolution and a print speed of 80 ppm (pages per minute). As the performance of image forming apparatuses increases, various proposals are being made to realize a further improvement in image quality, one of which is position correction for formed-pixel dots.

In order to form high-resolution pixel dots on a photosensitive member, it is necessary for pixel dot phasing to be aligned with high accuracy between the pixel dot array in the optical scanning direction (called "main scanning direction" hereinafter) and each optical scanning line (called "sub-scanning direction" hereinafter). Position correction control, which corrects the position of the formed-pixel dots in the main scanning direction and sub-scanning direction, respectively, has been proposed as a way to realize this.

A configuration in which the output clock of a PLL synthesizer that generates a reference clock for PWM is operated at a maximum oscillation frequency is disclosed in Japanese Patent Laid-Open No. 2004-249497. Japanese Patent Laid-Open No. 2004-249497 discloses continuously operating a PLL synthesizer that generates a clock having a higher frequency than an image clock and serving as a reference clock at a maximum oscillation frequency, and correcting the position, width, and so on of the pixel dots to be formed using a higher-frequency modulation unit.

Meanwhile, there is an image forming unit that exposes a subject to plural light sources, resulting from the emergence of multi-laser elements (VCSEL and so on). In order to form an image through scanning by controlling the flashes of plural light-emitting elements disposed in a matrix, it is necessary to temporally adjust individual element driving control and arrange the array of pixel dots formed on the photosensitive member. There has also been a proposal regarding pixel dot array control in which the correction of formed-pixel dot positions has been applied (see Japanese Patent Laid-Open No. 2006-175646).

SUMMARY OF THE INVENTION

In the above conventional examples, it is possible to correct the position, width diameter, and so on of pixel dots formed during optical scanning (during laser beam scanning) on an extremely small μm scale.

However, in order to reduce the quantization error amount when synchronizing a horizontal synchronization signal, which is a reference signal used for phase synchronization between lines, with an image clock, a synchronization clock is required to be generated at a high frequency. For this reason, there is a limit with current IC-operated clock bands, and thus there is a problem that a skew of several μm caused by a skew in the synchronization between lines may not be corrected, even at the beginning of the optical scanning.

There is an additional problem that a skew may arise in image formation between lines due to static deviation information such as deviation in the scanning magnification, dynamic deviation characteristics such as fluctuations in temperature, deterioration of the apparatus caused by age, and so on.

Embodiments of the present invention are provided to overcome or at least mitigate the above-described drawbacks of the related technology.

Having been conceived in light of the aforementioned problems, an embodiment is configured to eliminate or at least mitigate a skew in synchronization between lines and thus enable favorable image formation.

According to one aspect of the present invention, there is provided an image forming apparatus including a reference clock output unit that outputs a reference clock, an image clock generation unit that divides the outputted reference clock by a set multiple and generates an image clock based on the division, and a synchronization signal detection unit that detects a synchronization signal for synchronizing the timing of the start of optical scanning by a laser beam, the image forming apparatus irradiating the laser beam based on the synchronization signal detected by the synchronization signal detection unit and the image clock generated by the image clock generation unit, and comprising:

- a detection unit adapted to detect a width of the synchronization signal detected by the synchronization signal detection unit from when the signal goes to active to when the signal returns to non-active; and
- a correction unit adapted to correct the multiple based on the width of the synchronization signal as detected by the detection unit.

According to the present invention, a skew in synchronization between lines can be eliminated, thus enabling favorable image formation.

Further features of the present invention will become apparent from the following description of exemplary embodiments (with reference to the attached drawings).

DESCRIPTION OF THE EMBODIMENTS

First Embodiment

Hereinafter, exemplary preferred embodiments of the present invention shall be described in detail with reference to the diagrams. However, it should be noted that the constituent elements denoted in the following embodiments are to be taken as examples only; the technical scope of the present invention is defined by the appended claims, and is not intended to be limited by the individual embodiments described hereinafter.

(Configuration of Image Forming Apparatus)

Figure 8:
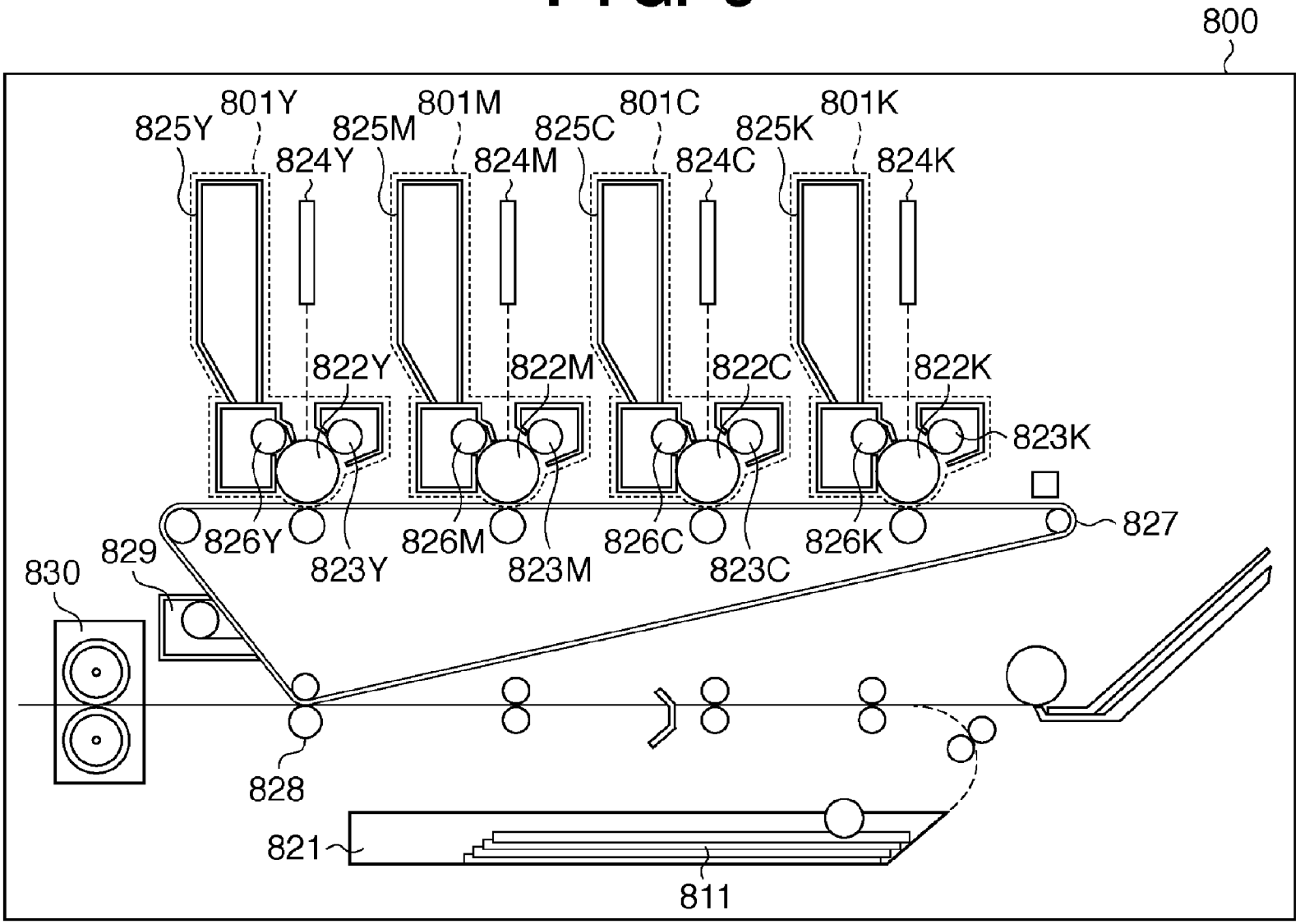
FIG. 8 is a diagram illustrating an example of a schematic configuration of an image forming apparatus according to an embodiment of the present invention.

FIG. 8 is a diagram illustrating an example of a schematic configuration of an image forming apparatus according to an embodiment of the present invention. The image forming apparatus is capable of producing a full-color image by superimposing toner images of four colors, or yellow, cyan, magenta, and black, upon one another, using an electrophotographic method. Note, however, that the present invention is not intended to be limited to a color image forming apparatus; the present invention can of course be applied in a monochrome image forming apparatus that uses an electrophotographic method.

An image forming unit 800 includes a feed unit 821, photosensitive members 822 (one for each of Y, M, C, and K), charging sleeves 823 (one for each of Y, M, C, and K), toner repositories 825 (one for each of Y, M, C, and K), and developing sleeves 826 (one for each of Y, M, C, and K). The image forming unit 800 further includes an intermediate transfer member 827, transfer rollers 828, and a heat fixing device 830.

Note that the photosensitive members 822, charging sleeves 823, toner repositories 825, and developing sleeves 826 are integrated into units, one each for Y, M, C, and K, resulting in all-in-one cartridges 801 (Y, M, C, and K) (also referred to simply as "cartridges" hereinafter). The cartridges 801 (Y, M, C, and K) are each configured so as to be removable.

The photosensitive members 822 (Y, M, C, and K) are charged by the charging sleeves 823 (Y, M, C, and K) in the cartridges 801 (Y, M, C, and K), which are present for each of yellow (Y), magenta (M), cyan (C), and black (K) colors. Exposure light (a laser) is irradiated onto the charged photosensitive members 822 (Y, M, C, and K) from scanner units 824 (Y, M, C, and K) based on an exposure time converted by an image processing unit (not shown), forming an electrostatic latent image on the photosensitive members 822 (Y, M, C, and K).

Toner images of each color are formed on the photosensitive members 822 (Y, M, C, and K) by the developing sleeves 826 (Y, M, C, and K), based on the electrostatic latent image and using toner from the toner repositories 825 (Y, M, C, and K). A multicolor toner image is then formed on the intermediate transfer member 827 by superimposing the four color toner images upon one another. The multicolor toner image (also referred to simply as a "toner image" hereinafter) formed on the intermediate transfer member 827 is transferred to a recording material 811 by being taken between the transfer rollers 828 and pressurized therebetween. The multicolor toner image is then fixed on the recording material 811 by the heat fixing device 830, and the recording material 811 is then discharged to a discharge tray (not shown). Toner remaining on the intermediate transfer member 827 is cleaned off by a cleaner 829, and the toner discarded as a result of the cleaning is accumulated in a cleaner repository (not shown).

Hereinafter, an embodiment shall be described in detail according to the flow indicated by the following numbers (1) through (7).

(1) First, the technical significance of static deviation characteristics and dynamic deviation characteristics in the present embodiment shall be discussed.

Figure 1:
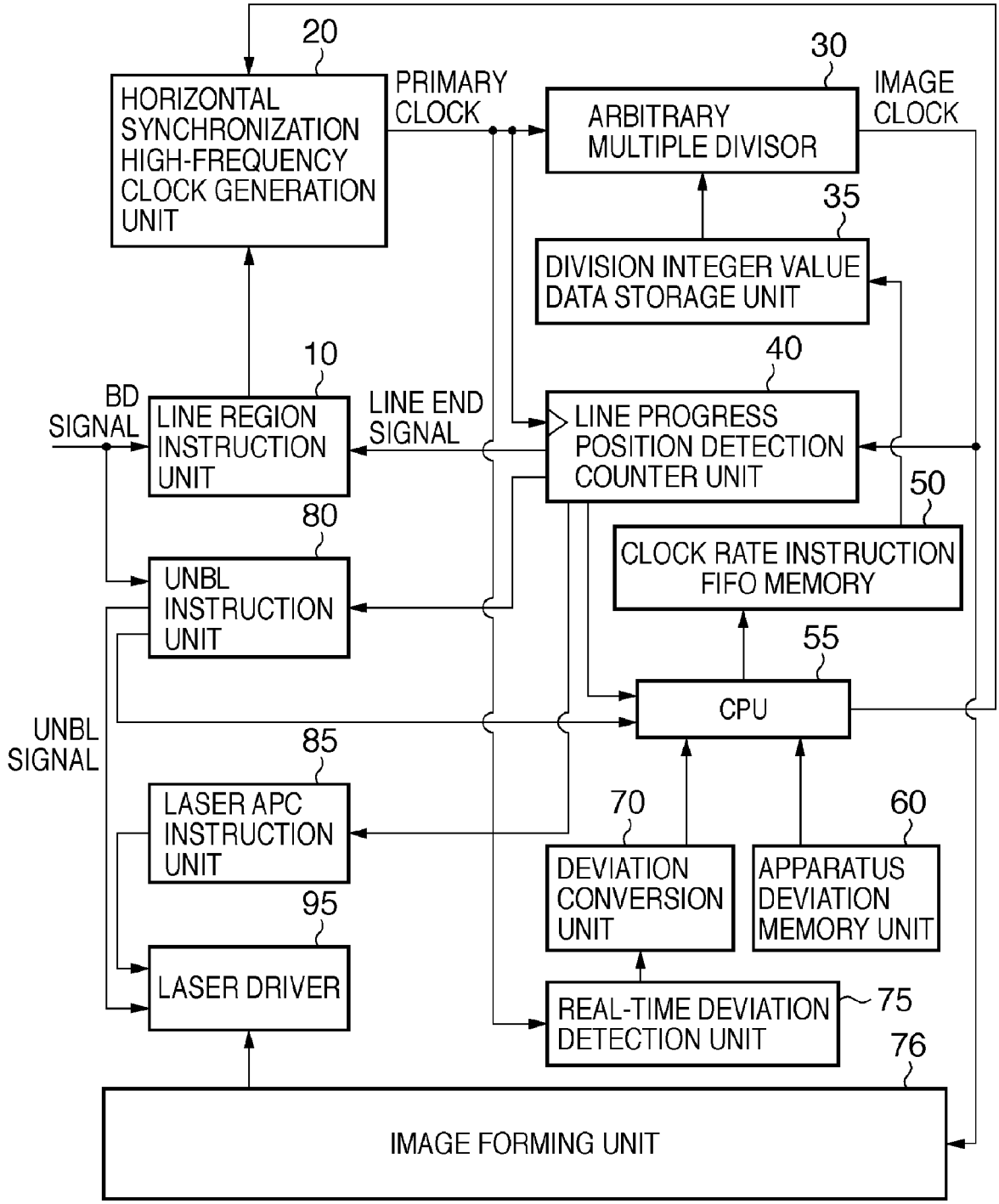
FIG. 1 is a block diagram illustrating a functional configuration of an image forming apparatus according to an embodiment of the present invention.

(2) Descriptions shall then be given regarding a function for reducing the quantization error amount when synchronizing a horizontal synchronization signal and an image clock, and the functionality of an image forming apparatus provided with a function for suppressing skew occurring between lines during image formation, with reference to FIG. 1.

(3) Then, the configuration of the horizontal synchronization high-frequency clock generation unit 20 illustrated in FIG. 1 shall be described in detail, with respect to the reduction of the quantization error amount when synchronizing the horizontal synchronization signal and the image clock.

Figure 3A:
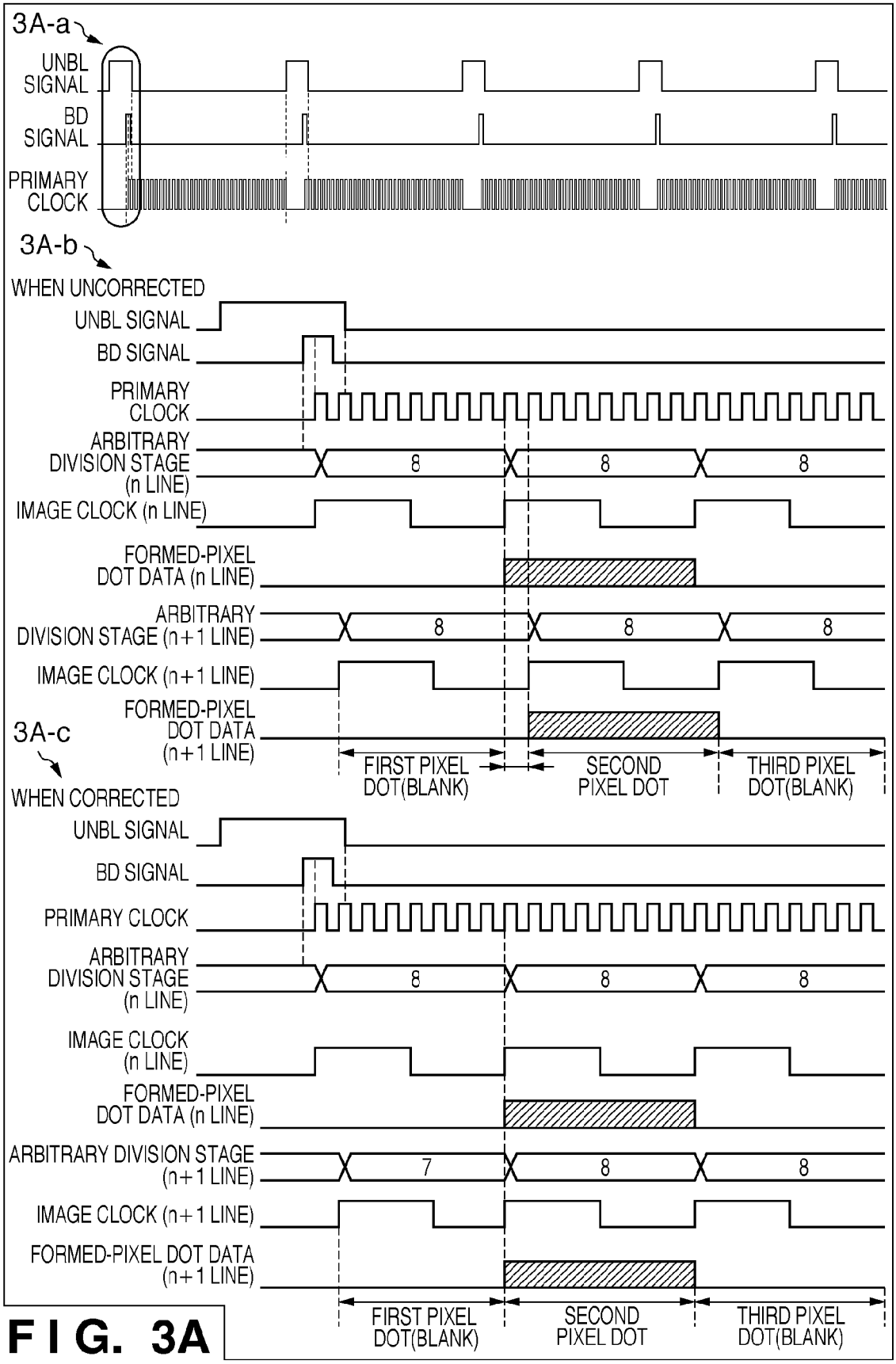
FIG. 3A is a diagram illustrating an example of correction control timing for forming pixel dots.
Figure 3B:
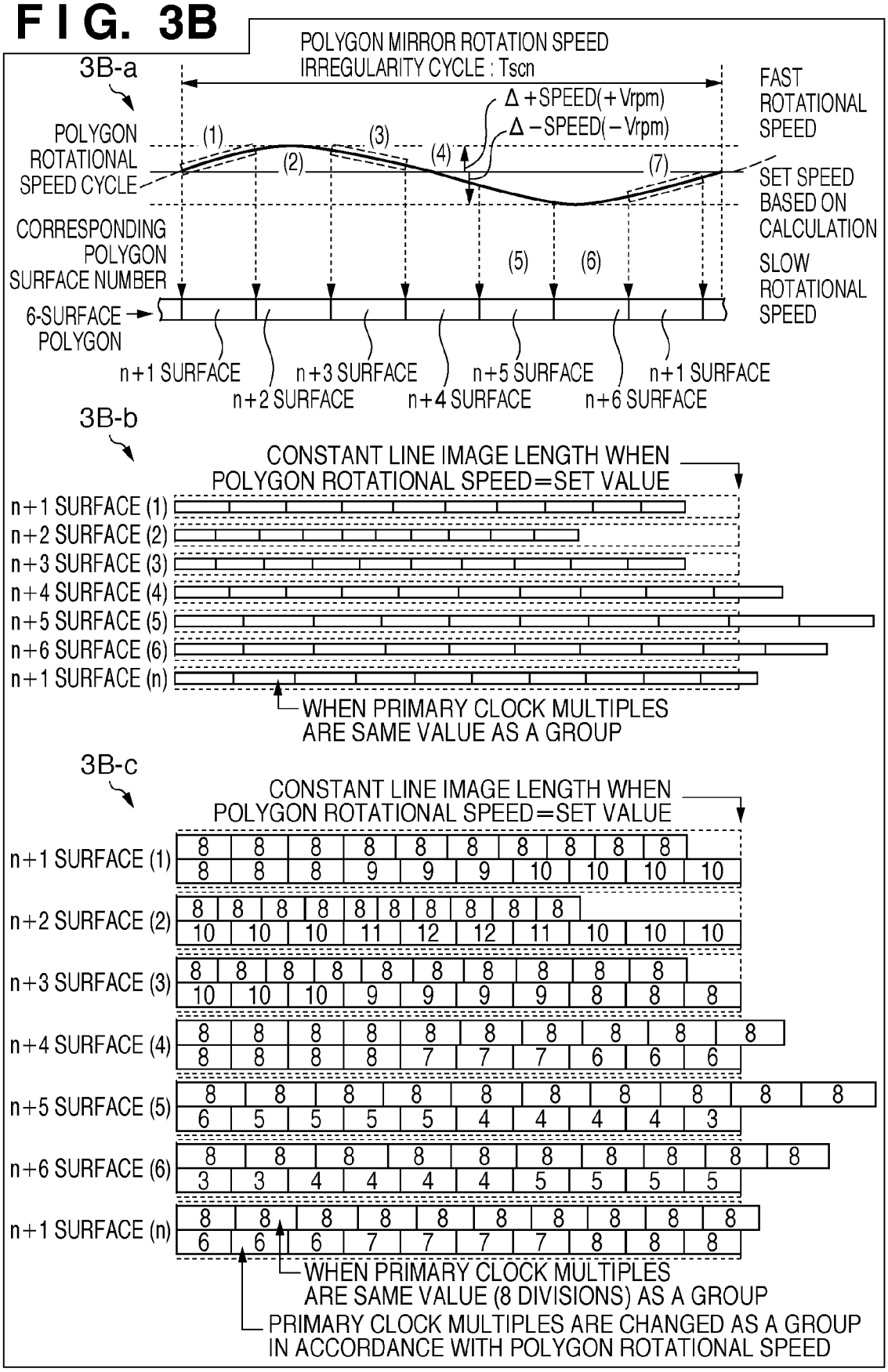
FIG. 3B is a diagram illustrating an example of correction control timing for forming a line image.

(4) Descriptions shall then be given regarding the results of operations implemented by the image forming apparatus, using FIGS. 3A and 3B.

(5) Then, the manner in which the real-time deviation detection unit 75 shown in FIG. 1 detects the BD signal shall be described with reference to FIG. 4, as an explanation of processing for correcting the dynamic deviation characteristics. Note that the BD signal refers to a synchronization signal for synchronizing the optical scanning start timing where the laser beam writes in the main scanning direction, detected outside of the image writing region.

(6) Next, how the dynamic deviation characteristics are corrected, and how the arbitrary multiple divisor 30 outputs the corrected image clock, shall be described with reference to FIG. 5.

(7) Finally, specific details regarding the computation processing carried out by the arbitrary multiple divisor 30 up until the corrected image clock is generated shall be provided.

(1) Regarding the static deviation characteristics and dynamic deviation characteristics (a) Regarding the Static Deviation Characteristics In order to accurately form pixel data expanded in the image processing unit as dots on the photosensitive member, it is necessary to carry out the optical scanning so that the position, width diameter, and so on of the formed-pixel dots are accurately reproduced. However, in the image forming apparatus, various tolerances are present with regards to the reproduction accuracy of the optical scanning optical system, which includes the scanner units 824 and so on; thus a scheme is necessary to realize a highly-accurate assembly.

For example, accuracy tolerances of the lens itself, as exemplified by scanning magnification, partial magnification, and so on, as well as accuracy error determined when the lens system is installed in the apparatus, can arise in the optical lens used for scanning. In addition, surface division error, in which errors in accuracy arise at the time of division even if the surface lengths are constructed to be uniform, arises in the surface lengths of the polygon mirror, and error variability appears in the surface lengths of each surface. Factors resulting in such congenital error in accuracy that are solidified in the construction process are called the "static deviation characteristics" of the image forming apparatus. To rephrase, these characteristics indicate accuracy error values that differ from constructed apparatus to constructed apparatus but are constant within a single apparatus. When image formation is carried out with pixel dots uniformly formed at equal transit times (i.e. the image clock), the characteristics of the scanning optical system lens, characteristics resulting from the surface division error of the polygon mirror surface, and so on are transferred as-is onto the photosensitive member due to the static deviation characteristics. For this reason, it is necessary to correct the position, width diameter, and so on for each of the formed-pixel dots. In other words, when the scanning optical system is incorporated into the image forming apparatus, the correction values of the lens system with respect to the photosensitive member differ depending on the image forming apparatus; however, these values are essentially constant within the same image forming apparatus. In order to correct scanning magnification, partial magnification, and so on in the scanning optical lens system, the deviation conversion unit may perform correction based on the correction data so as to eliminate the static deviation characteristics.

(b) Regarding the Dynamic Deviation Characteristics

On the other hand, the scanning speed of the laser (optical scanning speed) in the optical scanning optical system is the most important parameter for position correction, width diameter correction, and so on of the pixel dots to be formed, and influences the quality of the formed image. Even within the same image forming apparatus, the optical scanning speed is, for example, generated using the rotation of a motor, and thus deviation in the rotational speed of the motor affects the optical scanning speed. In other words, cyclical rotational irregularity arises even if the rotational speed of the motor is controlled so as to be a constant rotational speed. As a result, the fluctuation in the optical scanning speed is assumed to occur in real-time. To rephrase, the optical scanning speed changes in real time. Such a characteristic is classified as a static deviation characteristic, and is information unique to each apparatus. However, this characteristic cannot be identified by, for example, which polygon mirror is being used, as with the abovementioned surface division error, and thus in the present embodiment the term "dynamic deviation characteristics" is taken to mean that the respective surfaces of the polygon mirror are not correspondent with one another. Hereinafter, descriptions shall be given regarding real-time detection of accuracy attributed to the dynamic deviation characteristics, and correction performed in accordance with the results of this detection for eliminating the dynamic deviation characteristics.

Dynamic deviation characteristics arise latently due to various static deviation characteristics. Errors of centration in the polygon mirror of which the optical scanning optical system is configured, surface division errors in the polygon mirror, weight distribution with regards to the axial rotation of the polygon mirror, and so on, which are static deviation characteristics of the scanning optical system, can be given as examples. When optical scanning is executed under such conditions, adding the rotational operation of a motor for rotating the polygon mirror at a constant speed, irregularity (deviation) in the rotational speed of the polygon mirror can lead to various speed deviation values according to the values of the various static deviation characteristics. The result of synergetic aggregation based on plural factors and resulting from applying a certain operation to an object that has static deviation characteristics appears as the optical scanning speed, and can result in changes in the optical scanning speed that have minute deviations. An item called a balancer, made of clay or the like, used for adjusting the weight balance, is installed in an appropriate location in the actual polygon mirror, and by adjusting this balancer, fluctuations in the optical scanning speed can be adjusted. However, in an image forming apparatus aiming to achieve better image quality, it is necessary to correct the pixel dot formation in accordance with the optical scanning speed per pixel dot, in order to faithfully express the position, width diameter, and the like of the formed-pixel dots.

(2) Descriptions shall next be given regarding the functionality of an image forming apparatus provided with a function for reducing the quantization error amount when synchronizing a horizontal synchronization signal and an image clock, and a function for suppressing skew occurring between lines during image formation, with reference to FIG. 1.

(Functional Configuration of Image Forming Apparatus)

(Reduction of Quantization Error Arising in Phase Alignment between Image Clock and BD Signal)

FIG. 1 is a block diagram illustrating a functional configuration of the image forming apparatus according to an embodiment of the present invention. A BD signal (synchronization signal) is a reference signal for aligning the phase of pixel dot arrays between lines formed on a photosensitive member, and is inputted into a line region instruction unit 10. The line region instruction unit 10 also takes a line END signal (described later) as an input signal, and generates a control signal that goes to high (active) based on the input (reception) of the BD signal and goes to low (non-active) based on the input (reception) of the line END signal.

Along with aligning the phase of pixel dot arrays per line, the line region instruction unit 10 generates a video enable signal indicating an enabled range of image data (hereinafter called a "video signal") within a line. The reference clock begins being outputted in accordance with the input of the synchronization signal (BD signal) into the line region instruction unit 10, which functions as a synchronization signal input unit; this shall be described in further detail later. The line region instruction unit 10 inputs the video enable signal into a horizontal synchronization high-frequency clock generation unit 20.

The horizontal synchronization high-frequency clock generation unit 20 functions as a generation unit for generating a reference clock (hereinafter, also called a "primary clock") in synchronization with the start of scanning using laser light (in other words, a reference clock output unit). The horizontal synchronization high-frequency clock generation unit 20 generates a reference clock (primary clock) that serves as the source for image clock generation, based on the inputted video enable signal. The horizontal synchronization high-frequency clock generation unit 20 is configured of a DLL (Digital Locked Loop) circuit that uses the transport delay of a digital gate circuit such as that shown later as an example in FIG. 2. When the video enable signal is inputted into the horizontal synchronization high-frequency clock generation unit 20, oscillation of the reference clock (primary clock) in phase synchronization with the BD signal is commenced.

Until the oscillation of the reference clock (primary clock) commences, a constant transport delay time arises in the DLL circuit based at the rising edge of the video enable signal. In this case, with regards to variability in the transport delay, which becomes a clock jitter component, the DLL circuit is configured through digital gate circuits of the same frequency, and one cycle of the reference clock (primary clock) is repeatedly generated; thus the clock jitter component is almost entirely absent. As one example, only approximately 1/1000 of a jitter component is detected in a repeat of a single cycle of the primary clock.

The reference clock (primary clock) outputted from the horizontal synchronization high-frequency clock generation unit 20 is inputted into an arbitrary multiple divisor 30 and a line progress position detection counter unit 40 prior to the input of the BD signal of the next line. The horizontal synchronization high-frequency clock generation unit 20 stops the generation of the reference clock (primary clock) based on a signal indicating the end of scanning of one line on the photosensitive member, as detected by an optical scanning position detection unit (not shown).

Synchronization can be achieved between lines using the BD signal of the next line. The phases of the pixel dot arrays formed between lines are synchronized using the BD signals occurring in each line, and favorable reference clock (primary clock) with almost no clock jitter component is generated by the horizontal synchronization high-frequency clock generation unit 20.

To achieve favorable image formation, it is necessary to correct the skew between lines with a favorable array of pixel dots to be formed on the photosensitive member, and to perform phase alignment in each line.

The image forming apparatus according to the present embodiment is configured so that a clock is emitted in response to the emitted BD signal and the oscillation of the clock is stopped when a line ends, and thus the quantization error occurring when performing synchronization between lines can be suppressed to a minimum.

The primary clock outputted from the horizontal synchronization high-frequency clock generation unit 20 is inputted into the arbitrary multiple divisor 30, and is also inputted into the line progress position detection counter unit 40. The horizontal synchronization high-frequency clock generation unit 20 is provided with a frequency adjustment circuit that performs minute adjustments on the frequency of the outputted primary clock, and outputs that clock.

The arbitrary multiple divisor 30 can divide the frequency of the primary clock by an arbitrary integer value so as to restrict the frequency to an image clock frequency that has been set, and output the resultant as the image clock. The arbitrary multiple divisor 30 divides the primary clock based on a set multiple, and generates an image clock for controlling the timing of image formation on a pixel-by-pixel basis.

An image forming unit 76 can execute image formation based on the image clock for controlling the timing of image formation on a pixel-by-pixel basis outputted (corrected) by the arbitrary multiple divisor 30.

A CPU 55 stores correction data, calculated per line, for correcting the position of one line's worth of formed-pixel dots, in a clock rate instruction FIFO memory unit 50, the data being stored for each formed-pixel dot. The clock rate instruction FIFO memory unit 50 writes the correction data into a division integer value data storage unit 35, per formed-pixel dot, when a line is actually formed. The arbitrary multiple divisor 30 writes the data into the division integer value data storage unit 35 for each pixel dot (on a pixel-by-pixel basis), divides the primary clock by an arbitrary integer value based on the updated correction data, and outputs the image clock. The arbitrary multiple divisor 30 can correct the transit time, phase timing, and so on of one cycle of the image clock based on the correction data written into the division integer value data storage unit 35. Details shall be given later with reference to FIG. 3.

Meanwhile, the line progress position detection counter unit 40 can function as a counter for counting the primary clock, and can emit a timing signal when the counter value reaches a pre-set value. The line progress position detection counter unit 40 is further provided with functionality to detect various timings regarding pixel dots formed by the light that scans lines in the main scanning direction, and provide feedback to the deviation conversion unit.

A line end signal emitted by the line progress position detection counter unit 40 is inputted into the line region instruction unit 10, as described earlier. A timing signal emitted by the line progress position detection counter unit 40 is inputted into a UNBL instruction unit 80, and into a laser driver 95 via a laser APC instruction unit 85.

The BD signal and the timing signal outputted by the line progress position detection counter unit 40 are inputted into the UNBL instruction unit 80. The UNBL instruction unit 80 causes scanning light to be emitted in front of a light-receiving element in order to attain the reception timing of the BD signal, and emits a control timing signal for stopping the emission of laser light upon the BD signal being inputted. In the following descriptions, the control timing signal is indicated by the abbreviation "UNBL signal". The UNBL signal is inputted into the laser driver 95.

The laser driver 95 can control the amount of light of the laser, which is the scanning light source. In the case where light amount control is performed per line, the timing signal emitted by the line progress position detection counter unit 40 can be used for timing detection when scanning of one line on the photosensitive member finishes and the scanning moves to the next line.

An apparatus deviation memory unit 60 stores the dynamic deviation characteristics described above. Note that the dynamic deviation characteristics stored in the apparatus deviation memory unit 60 are the same as the example indicated by a in FIG. 3B, mentioned later, and shall be described in detail later as polygon rotational speed irregularity.

A real-time deviation detection unit 75, shown in FIG. 1, can detect the fluctuating amount of deviation in the optical scanning speed based on the interfacial angle speed, state of the reflective surfaces, and so on of the polygon mirror surfaces and other various factors. Note that details regarding the real-time deviation detection unit shall be described with reference to FIGS. 4 and 5A and 5B, which shall be mentioned later. The real-time deviation detection unit 75 inputs the results of its detection into the deviation conversion unit 70.

The deviation conversion unit 70 transfers data for correcting the deviation (for example, a time-scale value) to the CPU 55 as converted data, based on the data detected by the real-time deviation detection unit 75 (for example, the width of the BD signal based on the primary clock). Here, the width of the BD signal corresponds to the number of pulses from when the BD signal goes to high to when the BD signal drops back to low, as indicated by "b" in FIG. 4, which shall be described later. The deviation conversion unit 70 can be configured as a low-active circuit or a high-active circuit in order to distinguish a variation of the BD signal such as the BD signal goes to high or the BD signal drops back to low. The real-time deviation detection unit 75 can collect the deviation data for each surface of the polygon mirror, in tandem with sequence control of the image forming apparatus. It should be noted that the width of the BD signal does not refer to a length that uses actual meters as a unit, but rather can be converted into a primary clock number and thus corresponds to a length of time. The width of the BD signal does not fluctuate on the actual meter level.

Based on the dynamic deviation characteristic data, the CPU 55 stores correction data for correcting the position of one line's worth of formed-pixel dots in the clock rate instruction FIFO memory unit 50, the data being stored for each formed-pixel dot.

The CPU 55 can function as a correction unit that generates or outputs correction data for changing the multiple on a pixel-by-pixel basis, in order to correct the deviations (dynamic deviation characteristic data).

The arbitrary multiple divisor 30 writes the data into the division integer value data storage unit 35 for each pixel dot (on a pixel-by-pixel basis), and divides the primary clock by an arbitrary integer value based on the updated correction data. At this time, the division of the primary clock reflects the correction data based on the dynamic deviation characteristic data. By applying the deviation correction data per cycle of the image clock generated by the arbitrary multiple divisor 30 (per pixel), the formed-pixel dots can be formed in relatively favorable positions with respect to arrays within a single line and the phase between lines. At this time, the CPU 55 can function as a control unit that controls the scanning optical system based on the image clock corrected based on the correction data.

(3) Next, the configuration of the horizontal synchronization high-frequency clock generation unit 20 illustrated in FIG. 1 shall be described in detail, with respect to the reduction of the quantization error amount when synchronizing the horizontal synchronization signal and the image clock.

(Exemplary Configuration of Horizontal Synchronization High-frequency Clock Generation Unit 20)

Figure 2:
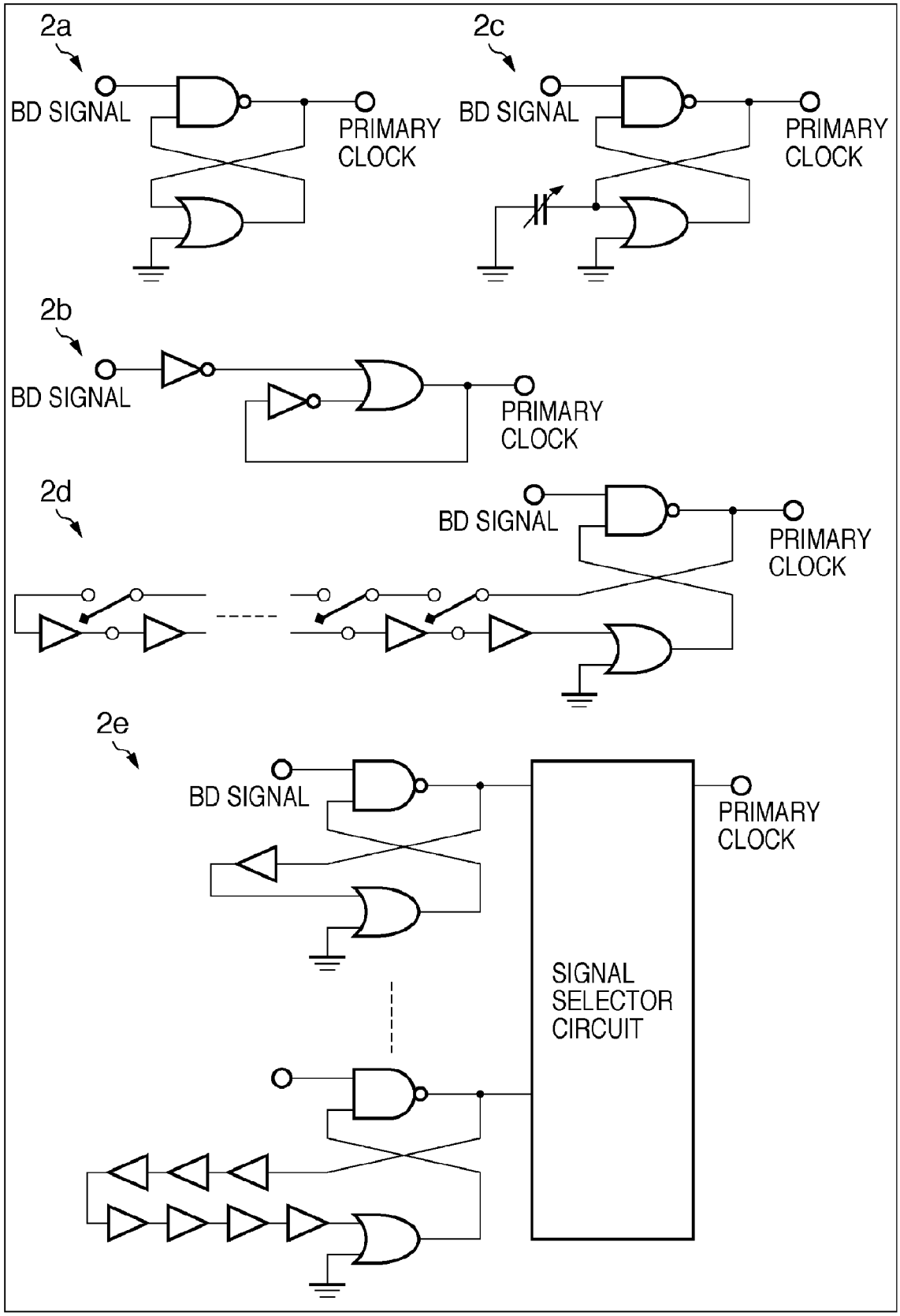
FIG. 2 is a diagram illustrating an example of the configuration of a horizontal synchronization high-frequency clock generation unit 20.

Next, the DLL circuit portion of the horizontal synchronization high-frequency clock generation unit 20 shall be described using FIG. 2. "2*a*" in FIG. 2 indicates a general digital multi-vibrator circuit; with this circuit, when the input goes to high-level, the oscillation of the primary clock commences following the gate transport delay time. The transport delay time can be determined by the configuration of the transistor in the gate circuit. The configuration illustrated in "2*a*" in FIG. 2 combines a NAND gate circuit and an OR gate circuit. Meanwhile, "2*b*" in FIG. 2 is an example of a configuration in which a NOT gate circuit and an OR gate circuit have been combined. The horizontal synchronization high-frequency clock generation unit 20 commences oscillation of the primary clock following the gate transport delay time in synchronization with the rising edge of the input of the BD signal (for example, the front edge portion 305 illustrated in "3A-c" in FIG. 3), through the DLL circuit. When the UNBL signal next goes to high-level based on the line END signal resulting from one line's worth of image being written, the CPU 55 can control the horizontal synchronization high-frequency clock generation unit 20 to stop the oscillation of the primary clock.

It goes without saying that the DLL circuits illustrated in "2*a*" and "2*b*" in FIG. 2 are exemplary, and the DLL circuits can be configured using gate transport delay, through the circuit configurations indicated in "2*c*" through "2*e*" in FIG. 2. For example, a configuration in which circuits of differing gate transport delay characteristics are provided in plural steps in parallel, and which includes a signal selector circuit 201 that operates under the control of the horizontal synchronization high-frequency clock generation unit 20, is also possible, as illustrated in "2e" in FIG. 2. According to the configuration of "2e" in FIG. 2, frequencies of primary clocks having differing gate transport delays (delay times) can be selected and outputted using the signal selector circuit 201.

The oscillation and stopping thereof of the primary clock can be controlled in synchronization with the BD signal by using the gate transport delay. Furthermore, if the DLL circuit is configured of the same gate circuit, the amount of transport delay time in the primary clock that commences oscillation due to the BD signal emitted is approximately the same amount of time for each line, and therefore phase variability from line to line is of a value that can essentially be ignored. In other words, the occurrence of cyclical jitter in the primary clock frequency caused by variability in the gate transport delay is reduced.

However, in the case of a DLL circuit, setting the frequency of the primary clock to a desired value (making minute adjustments) is problematic. For that reason, the frequency is divided by arranging a configuration, which is separate from but identical to the arbitrary multiple divisor 30, in the next stage of the circuit configurations indicated in "2a" through "2e" in FIG. 2, which makes it possible to generate a primary clock frequency with minute adjustments.

(4) Descriptions shall now be given regarding the results of operations implemented by the image forming apparatus of the present embodiment, using FIGS. 3A and 3B.

FIG. 3A is a diagram illustrating an example of correction control timing for forming pixel dots. In FIG. 3A, the UNBL signal (control timing signal) is an output signal that is turned on when one line's worth of image has been written, and is outputted from the UNBL instruction unit 80. The UNBL signal is turned off upon detection of the BD signal. As shown in FIG. 3, the oscillation of the primary clock stops when one line's worth of image has been written, using the UNBL signal, which indicates the start of writing of a line image, as the starting point ("3A-a" in FIG. 3A).

"3A-b" in FIG. 3A is a timing chart, showing an uncorrected state, that focuses on the timing indicated by reference numeral 301 in "3A-a" in FIG. 3A. Meanwhile, "3A-c" in FIG. 3A is a timing chart, showing a corrected state, that focuses on the timing indicated by reference numeral 301 in "3A-a" in FIG. 3A.

The primary clock outputted from the horizontal synchronization high-frequency clock generation unit 20 is an image clock that has been divided 8 times by the arbitrary multiple divisor 30. While the multiple given in the example shown in FIG. 3A is "8", the present invention is not intended to be limited to this multiple. The multiple can be determined arbitrarily as appropriate for conditions such as the PWM bit number, position correction, dot width diameter correction, and so on, in accordance with the specifications of the image forming apparatus. Using the multiple "8" results in an image clock 8 times the size of the primary clock. The image clock multiplied by 8 as a result of the division of the primary clock generated based on the BD signal is outputted by the arbitrary multiple divisor 30.

In the nth line, the first three pixel dots are formed, and in the next line, or the n+1th line, the first three pixel dots are formed in the same manner, thereby forming a vertical line of single dots. In "3A-b" and "3A-c" in FIG. 3A, the portions corresponding to a first pixel dot and a third pixel dot are blank, and the portion indicated by crosshatching (a second pixel dot) corresponds to a portion in which a vertical line of single dots is formed. It is assumed here that, due to deviation in the optical scanning speed of the polygon scanner, an inter-line pixel dot skew 302 of ⅛ of a dot (equivalent to one pulse of the primary clock) has occurred at the second pixel dot, between the nth line and the n+1th line.

When performing correction, in order to generate an image clock 303 corresponding to the blank portion in which a pixel dot has not been formed (the first pixel dot), the multiple of the first pixel dot is controlled to be shorter by one pulse of the primary clock. In other words, the arbitrary multiple divisor 30 can cause the timing of the image clock going to high to match in the nth line and the n+1th line by performing control for changing the multiple "8", from the uncorrected state, to be a multiple "7". Through this, the inter-line pixel dot skew 302 occurring in the uncorrected state can be eliminated through correction.

In "3A-c" in FIG. 3A, an example was given in which the multiple was reduced from 8 to 7. However, the present invention is not intended to be limited to this example; the arbitrary multiple divisor 30 can, for example, perform control that delays the output of the image clock in the n+1th line by increasing (changing) the multiple of the image clock 303 corresponding to the blank portion in which a pixel dot is not formed from 8 to 9.

In addition, position correction of pixel dots can be performed per 1/n dot (an integer of $n \geqq 2$) by combining the abovementioned correction method with PWM under the control of the CPU 55. Furthermore, the width of the pixel dots to be formed can be corrected through the original function of PWM, and thus the position of the pixel dots to be formed can be corrected by combining the abovementioned correction methods.

Correcting the position of a single pixel on a pixel-by-pixel basis has been described thus far with reference to "3A-a" through "3A-c" of FIG. 3A.

Hereinafter, correction control timing for forming pixel dots that is different from that illustrated in FIG. 3A shall be described with reference to "3B-a" through "3B-c" of FIG. 3B.

First, it should be noted that the polygon rotational speed irregularity shown in "3B-a" of FIG. 3B (the observed rotational speed irregularity) is an example devised to make descriptions of the present invention easier. The polygon rotational speed cycle does not necessarily have to be a fixed value, and may fluctuate depending on the apparatus, the environment, the time, and so on.

The sine wave indicated in "3B-a" of FIG. 3B indicates the polygon rotational speed irregularity, and the corresponding polygon surface numbers are assigned to the scanning surface of the polygon mirror present at that point in time. "3B-a" of FIG. 3B illustrates a phase relationship in the case where polygon rotational speed irregularity occurs in a polygon with six surfaces at a cycle equivalent to seven surfaces. Because the polygon rotational speed irregularity is in an asynchronous relationship within the phase relationship with the polygon mirror surfaces, the phase relationship is not necessarily identical to that shown in FIG. 3B; rather, a random phase relationship is maintained. "3B-a" of FIG. 3B illustrates a phase relationship of a randomly corresponding polygon surface with respect to the timing of a certain polygon rotational speed irregularity.

The portion of the polygon rotational speed irregularity indicated by (1) in FIG. 3B indicates that the rotation is increasing in speed, moving away from the default value of the polygon rotational speed. As a result, the image line formed is shorter than the distance indicated by the dotted box in (1) of "3B-b" of FIG. 3B, which indicates the case where the speed is constant. Furthermore, because each individual pixel is a predetermined fixed multiple of the primary clock, the individual pixel lengths also become increasingly smaller in the same manner. In other words, with the polygon rotational speed irregularity indicated in (1), the dot is formed at a smaller size at the end portion of the line, and the overall image length of the formed line is shorter. Similarly, the portion of the polygon rotational speed irregularity indicated by (2) in "3B-a" of FIG. 3B continues on from the end of the polygon rotational speed indicated by (1), further increasing in speed until hitting a peak, after which the polygon rotational speed begins to slow back down. As a result, the image line formed is further shorter than the distance indicated by the dotted box in (2) of "3B-b" in FIG. 3B, which indicates the case where the speed is constant. The individual pixels are predetermined fixed multiples of the primary clock, and thus the pixel lengths in the central portion of the overall line are formed as the smallest, gradually widening toward the sides of the line. With the polygon rotational speed irregularity indicated by (2), a line image is formed with a completely different scanning rhythm than the rhythm of the formed dots indicated by (1).

In "3B-b" of FIG. 3B, differences appear in the scanning rhythm between lines in one cycle's worth of polygon rotational speed irregularity, as indicated by (3) to (7), following (2). As can be seen in FIG. 3B, the image lengths in each line change in the same manner as the sine wave in accordance with the state of the polygon rotational speed irregularity indicated in "3B-a" of FIG. 3B. In other words, if multiples of the primary clock are taken as the image clock at all fixed values, as per the conventional art, there are cases where the polygon rotational speed irregularity appears as-is in the image; the are also cases where values are selected so that the polygon rotational speed irregularity is not noticeable. According to the embodiment of this invention, it is possible to obtain a high definition image without using the conventional art.

Control corresponding to the cases described above is illustrated in "3B-c" of FIG. 3B. The descriptions given here shall assume that the set standard multiple of the primary clock for generating the image clock is 8, similarly to the discussions given with reference to FIG. 3A. A multiple of 8 is taken as the standard for each pixel. The CPU 55 sets the multiple in accordance with the polygon rotational speed.

In other words, at a standard scanning speed, pixel dot formation is executed using the image clock generated based on a multiple of 8. In the case where the polygon rotational speed changes as indicated by (1) in "3B-a" of FIG. 3B, correction control may be carried out while gradually adjusting the multiple value to the slope of the speed deviation, as indicated by (1) in "3B-c" of FIG. 3B. In other words, in order to reflect the state of the change in the polygon rotational speed in the state of the change in the scanning speed, the multiple of the primary clock that generates the image clock may be corrected in accordance with the state of the change. To put it differently, when polygon rotational speed irregularity such as that illustrated in (1) through (7) in "3B-a" of FIG. 3B arises, executing image formation while correcting the multiple as indicated in (1) through (7) in "3B-c" of FIG. 3B makes it possible to obtain a favorable image. Through this, synchronization skew between lines can be eliminated, and favorable image formation becomes possible.

(5) Next, the manner in which the real-time deviation detection unit 75 shown in FIG. 1 detects the width of the BD signal (the primary clock number) shall be described with reference to FIG. 4, as an explanation of processing for correcting the dynamic deviation characteristics.

The real-time (asynchronous to the polygon surface cycle) detection of dynamic deviation data and position correction or width diameter correction of pixel dots formed shall be described with reference to FIGS. 4 and 5. In "4*a*" of FIG. 4, reference numeral 100 indicates a light-receiving element, reference numeral 110 indicates a photosensitive member (this corresponds to reference numeral 822 in FIG. 8), and reference numeral 120 indicates a laser light source capable of emitting a laser. Reference numeral 130 indicates a scanner device, provided with a multi-surfaced polygon mirror 140 (rotational scanning unit), which is a rotational member for optical scanning, and a motor that rotates the polygon mirror 140 at a predetermined speed. The laser light emitted from the laser light source 120 is reflected by the polygon mirror 140, and is led to the photosensitive member 110. The light-receiving element 100 is disposed in the vicinity of the photosensitive member 110, and can receive laser light at a timing immediately prior to the laser light being led to the photosensitive member 110. Upon the laser light being received by the light-receiving element 100, the BD signal is outputted as a detection signal thereof. This BD signal output corresponds to "BD signal" indicated in FIGS. 1 and 2.

In the case where the error of the facial distance of each surface of the polygon mirror 140 is zero (in other words, the static deviation is 0), and the rotational speed is constant (in other words, the dynamic deviation is 0), the primary clock generated based upon the BD signal and position on the photosensitive member 110 can indicate a constant position. In other words, pixel dots can be formed without positional skew arising between lines. The pixel dots on the photosensitive member 110 formed by the irradiated laser light are formed in the same position in all lines, according to the timing based on the image clock divided using the primary clock.

However, if rotational deviation, which is one of the dynamic deviation characteristics, arises in the polygon mirror 140 (rotational scanning unit), a BD signal of a consistent signal width cannot be detected.

Figure 4:
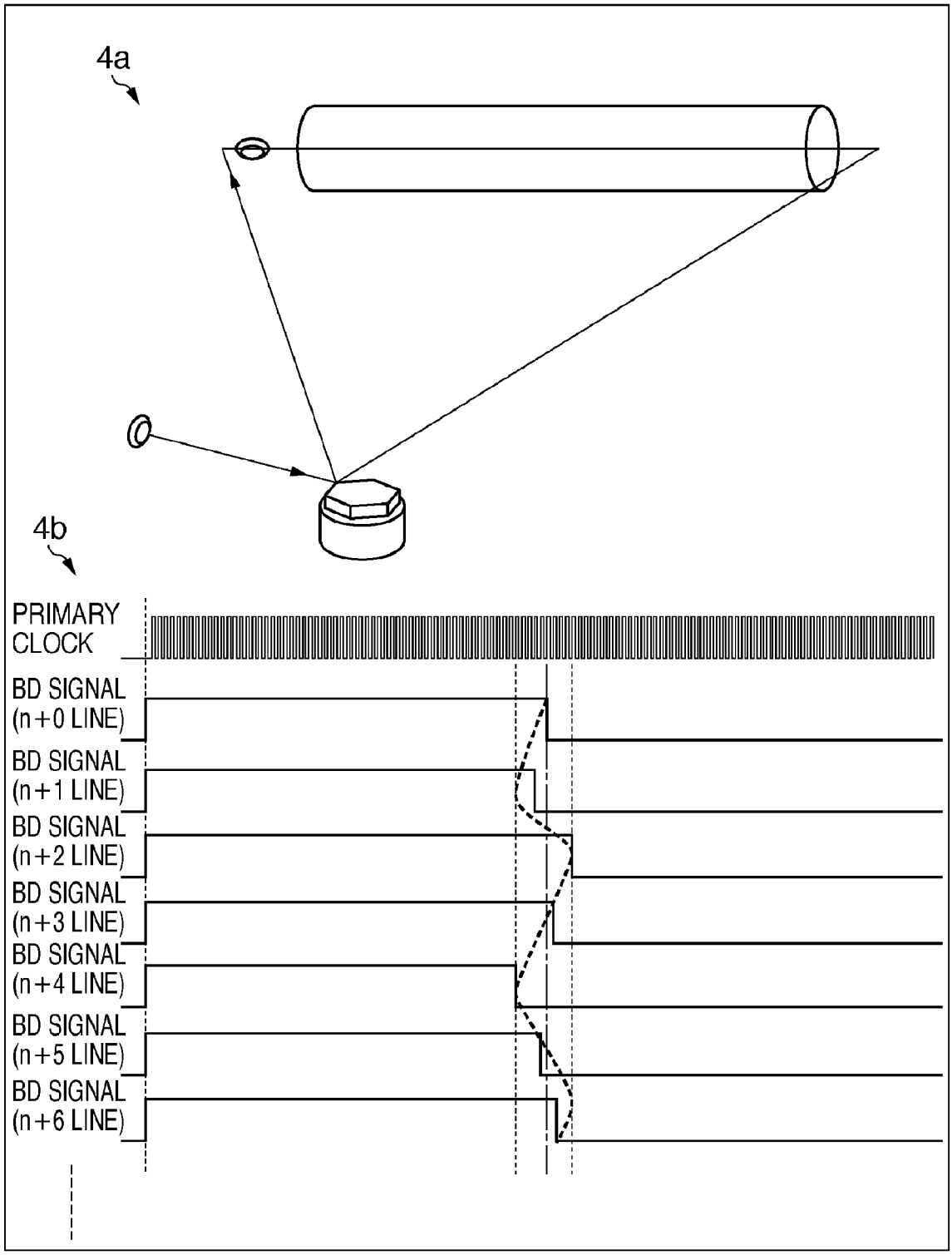
FIG. 4 is a diagram illustrating the correction of dynamic deviation characteristics according to a first embodiment of the present invention.

"4*b*" in FIG. 4 illustrates an exemplary relationship between the primary clock when dynamic deviations occur and the BD signal width in each line (lines n+0 to n+6). The dynamic deviation characteristics are as described earlier.

The real-time deviation detection unit 75 can count the number of the primary clock outputted from the horizontal synchronization high-frequency clock generation unit 20 and detect the BD signal width (the number of pulses of the detected signal (the primary clock)). The real-time deviation detection unit 75 inputs the results of this detection into the deviation conversion unit 70. The deviation conversion unit 70 performs time conversion on the inputted primary clock number (BD signal width (the number of pulses of the detected signal (the primary clock))) and transfers the results of this conversion as conversion data to the CPU 55. In the present embodiment, the primary clock is divided by the arbitrary multiple divisor 30 in accordance with the dynamic deviation characteristics, based on the primary clock number detected by the real-time deviation detection unit 75. Details shall be provided later.

(6) Next, how the dynamic deviation characteristics are corrected, and how the arbitrary multiple divisor 30 outputs the corrected image clock, shall be described in detail with reference to FIG. 5.

The CPU 55 generates correction data corresponding to the time conversion value that corresponds to the BD signal width (the number of pulses of the detected signal (the primary clock)), and stores the generated correction data in a look-up table. Note that in this look-up table, if the polygon mirror 140 (rotational scanning unit) has six surfaces, the data of the measured surfaces can be classified as the n+0 surface for the first measured surface, n+1 for the second, and so on up to n+6, in accordance with the number of surfaces (N).

Figure 5:
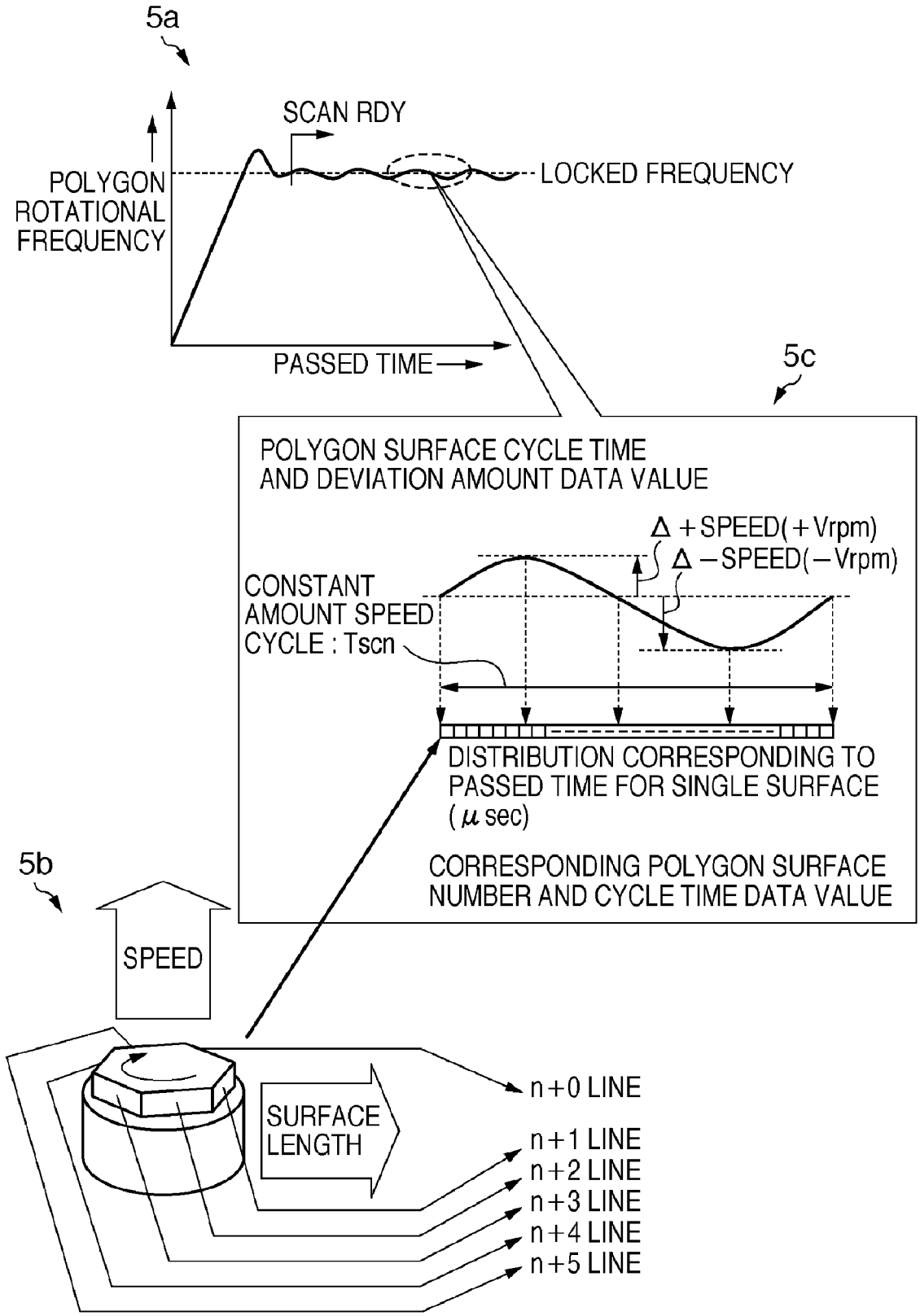
FIG. 5 is another diagram illustrating the correction of dynamic deviation characteristics according to the first embodiment of the present invention.

"5*b*" of FIG. 5 shows an example in which the polygon mirror 140 (rotational scanning unit) of the scanner device 130 has six surfaces. When the polygon mirror 140 (rotational scanning unit) rotates, the rotational frequency of the polygon mirror increases as indicated in "5*a*" of FIG. 5, after which the rotational frequency (rotational speed) is restricted to the clock frequency.

However, as described earlier, even if adjustment is performed using a balancer, deviation will arise in a certain range of speed at a certain time cycle. This fluctuation is the dynamic deviation characteristic described earlier.

"5*c*" in FIG. 5 illustrates an enlargement of a single cycle's worth of this deviation portion; here, deviation, in which the rotational frequency (speed) of the polygon mirror increases or decreases, arises at a period comparatively longer than the surface cycle of the polygon. In other words, the rotational frequency (speed) of the polygon mirror increases and decreases at differing periods that are longer than the switch cycle of each surface of the polygon mirror 140 (rotational scanning unit).

The real-time deviation detection unit 75 counts the primary clock at a specific timing at which the image forming apparatus operates, and detects the BD signal width (the number of pulses of the detected signal (the primary clock)). The deviation conversion unit 70 then performs time conversion on the inputted primary clock number (BD signal width (the number of pulses of the detected signal (the primary clock))) and transfers the results of this conversion as conversion data to the CPU 55. The CPU 55 can find the dynamic deviation characteristics data based on the inputted converted time. The CPU 55 then identifies the correction data for the dynamic deviation characteristics data, and stores, with each identification, correction data for correcting the position of one line's worth of formed-pixel dots, for each surface of the polygon mirror 140, in the clock rate instruction FIFO memory unit 50.

More specifically, the CPU 55 then stores the correction data, which reflecting the time conversion data inputted from the correction execution look-up table stored in advance in the deviation memory unit 60 of the apparatus, in the clock rate instruction FIFO memory unit 50 on a formed-pixel dot basis. The clock rate instruction FIFO memory unit 50 writes the correction data into a division integer value data storage unit 35, per formed-pixel dot, when a line is actually formed. The arbitrary multiple divisor 30 divides the primary clock by an arbitrary integer value based on the correction data written into the division integer value data storage unit 35 for each pixel dot and updated, and outputs the image clock. The image clock outputted from the arbitrary multiple divisor 30 reflects the correction data, and by executing image formation based on this image clock, synchronization skew arising between lines can be eliminated, making a more favorable image formation possible.

Note that the pulse width of the BD signal (the time corresponding to a certain primary clock number) described in the context of the correction control is equivalent to the time when a raw signal of the light-receiving element that receives the BD signal is measured. The reception time for light that scans the surface lengths of a single light-receiving element is set proportionally to the optical scanning speed. In other words, differences in the optical scanning speeds appear as differences in the pulse width of the BD signal emitted from the light-receiving element. At this time, if the cycle time is longer than the scanning time for one line of an image (the BD signal cycle), such as when polygon rotational speed irregularity occurs, the change of scanning irregularity within a single line is comparatively gradual. For this reason, if part of the slope within a line can be isolated, the state of change throughout the entire line can be calculated. Here, the time phase at the time of the end of the BD signal is similar to the phase of a single cycle of the polygon rotational speed irregularity, as indicated by "4*b*" in FIG. 4.

(7) Hereinafter, details regarding the computation processing carried out by the arbitrary multiple divisor 30 up until the corrected image clock is generated shall be provided.

More specifically, descriptions shall be given regarding a unit for calculating how much a line image (the image recorded across a single main scanning line) has lengthened/shortened (a dynamic deviation characteristics calculation method described in the present invention), correcting the multiple of the primary clock, and dividing the image clock cycle time length.

In general, control of the rotational speed of the motor that drives the polygon mirror is carried out within a certain range using servo control or the like, so that the rotation is constant. However, in actuality, polygon rotational speed irregularity such as that indicated by "3B-a" in FIG. 3B arises due to the dynamic deviation characteristics described above.

The polygon rotational speed cycle indicated in "3B-a" in FIG. 3B is determined by the optical scanning system unit installed in the device, known as an "optical box", and therefore the change deviation amount (peak value) and width (frequency) of the polygon rotational speed is determined by the individual motors that rotate the polygon mirror and the control system circuit thereof.

In other words, the change deviation amount (peak value) and width (frequency), known as the polygon rotational speed irregularity, are values that are unique to the individual optical box unit installed in the device. Once the optical box has been installed in a device, the rotational speed irregularity is for the most part fixed, and does not fluctuate, despite slight variations due to changes in temperature during operation. Thus the rotational speed irregularity is repeated in a cycle unique to the optical box unit and is translated to the image in a constant rhythm. With the exception of breakdowns, malfunctions, and so on, the differences present are limited to variability of control, but the error resulting therefrom is of an amount that can be ignored, and generally does not change.

Therefore, the polygon mirror rotational speed irregularity data unique to the optical box unit installed in the device as mentioned here is measured and stored, in advance, as static deviation characteristics in the installed apparatus deviation memory unit 60. In other words, the information of the polygon mirror rotational speed irregularity indicated by, for example, the sine wave (the speed change in the cycle time) illustrated in "3B-a" of FIG. 3B is stored in advance in the apparatus deviation memory unit 60. Then, the CPU 55 sets the correction multiple as illustrated below, using this sine wave stored in advance in the apparatus deviation memory unit 60.

1. The real-time deviation detection unit 75 detects the width, or time length, of the BD signal by counting the number of the primary clock outputted from the horizontal synchronization high-frequency clock generation unit 20. This is taken as BD1(n), for the sake of convenience. n represents the number of surfaces. While the polygon mirror rotates, the CPU 55 calculates an average "BD1ave" based on the detected BD1(n), and stores the BD1ave in the apparatus deviation memory unit 60. For example, the BD1ave is calculated in advance, when the image forming apparatus is activated, or the BD1ave, which is measured in advance in a factory, may be stored as an ideal value in the apparatus deviation memory unit 60.

2. The CPU 55 calculates an average "BD1max" of a maximum value among the BD1(n) detected in each predetermined period, and stores the BD1max in the apparatus deviation memory unit 60. The timing of the calculation of BD1max is the same as that of BD1ave. The CPU 55 calculates a coefficient "BDreg" in order to normalize the sine wave of the BD1(n) based on the BD1ave and the BD1max.

$$BD\text{reg}=1\div(BD1\text{max}-BD1\text{ave}) \quad \text{Equation 1}$$

3. The sine wave illustrated in "3B-a" in FIG. 3B is stored in the apparatus deviation memory unit 60 in advance In order to compare with the BD1(n) to be hereinafter described, the amplitude of the sine wave is normalized into "±1".

4. It is possible to obtain the following equations 2 and 3.

$$(BD1(n)-BD\text{ave})\times BD\text{reg}=y=\sin\theta \quad \text{Equation 2}$$

$$\theta=\sin^{-1}((BD1(n)-BD\text{ave})\times BD\text{reg}) \quad \text{Equation 3}$$

5. Meanwhile, the change in the width, or time length, of the BD signal illustrated in "4*b*" of FIG. 4 is stored, and the amount of change is taken as ΔBD1(n).

The extension of the length of a single scanned line, as indicated in "3B-b" of FIG. 3B, appears in the width of the BD signal (pulse time width (primary clock number)), as illustrated in "4*b*" of FIG. 4. Neither the width of the light-receiving element (specifically, the width of an element that receives light using a 5 mm-square chip) that detects the beam upon which the BD signal is based nor the scanning length of the single line change. That is, the scanning speed deviation amount appears in the BD signal width at a similar ratio. To put it differently, a fluctuation similar to the polygon rotational speed irregularity (dynamic deviation characteristic) that resembles the sine wave illustrated in FIG. 5 appears in the width of the BD signal. Accordingly, the phase of the polygon rotational speed irregularity can be identified based on the degree to which the width of the BD signal changes, and the manner in which the polygon rotation speed will change within that line length can be predicted in real-time.

6. Then, the CPU 55 finds θ in real-time using the following calculations.

if $\Delta BD1(n)>0$, a value in the range of $-1/2\pi<\theta<1/2\pi$ is taken as θ from the phase obtained from Equation 3.

if $\Delta BD1(n)=0$ and $\Delta BD1(n-1)>0$, $\theta=1/2\pi$, as obtained from Equation 3.

if $\Delta BD1(n)=0$ and $\Delta BD1(n-1)<0$, $\theta=-1/2\pi$, as obtained from Equation 3.

if $\Delta BD1(n)<0$, a value in the range of $1/2\pi<\theta<-3/2\pi$ is taken as θ from the phase obtained from Equation 3.

7. Furthermore, θ is segmented into individual segments at a predetermined time interval, and an array table, in which an array of the multiples has been allocated in advance to those segments, is stored in the apparatus deviation memory unit 60.

8. The CPU 55 loads the array table from the apparatus deviation memory unit 60 and cross-references θ found using the calculation described in 5 above with the array table. The CPU 55 then identifies which segment θ is included in, loads the value of the multiple allocated to that segment from the array, and generates correction data for correcting the positions of one line's worth of the formed-pixel dots. Furthermore, the CPU 55 stores the generated array value per formed-pixel dot in the clock rate instruction FIFO memory unit 50 as correction data. The results thereof are indicated in "3B-c" of FIG. 3B.

As a preliminary operation for commencing printing operations, a printer initiates polygon rotation that increases to the set scanning speed, for a sampling time used to grasp the state of change in the polygon rotational speed based on the change in the pulse width, or time amount, of the BD signal. A signal indicating that the device is ready for scanning is emitted upon the polygon rotational speed reaching the set value, the signal indicating that the optical scanning speed has been locked to within a constant range. Paper is then fed into the apparatus, image forming operations are commenced, and the operations are stopped after a predetermined number of prints have been made. A minimum of several seconds is required for image forming to commence after the signal indicating that the device is ready for scanning has been emitted. These several seconds are equivalent to several thousand emissions of the BD signal (necessary time for a single line), and thus there is sufficient time to sample the state of change in the polygon rotational speed, calculate that change, and execute control for confirming the change. Thus, in what manner the polygon rotational speed cycle will change with respect to the line length can be understood without problems, based on the state of change in the degree to which the width of the BD signal changes.

Effects of First Embodiment

As described above, the primary clock can be activated using a circuit illustrated in FIG. 2, which makes it possible to reduce the quantization error amount when synchronizing the horizontal synchronization signal and the image clock.

Furthermore, in addition to reducing the quantization error amount, the multiple for generating the image clock is set in accordance with the width of the BD signal detected by the real-time deviation detection unit 75, eliminating synchronization skew between lines with more accuracy, and thus making it possible to achieve more favorable image formation.

Second Embodiment

In the second embodiment, descriptions shall first be provided regarding the operations of a transport delay oscillator circuit unit 21, which is configured of a DLL circuit that utilizes the transport delay of the digital gate circuit found in the horizontal synchronization high-frequency clock generation unit 20 as configured in FIG. 2. Then, a frequency stabilizing correction unit for the primary clock, which is a characteristic of the present embodiment, shall be described with reference to FIG. 7.

Figure 6:
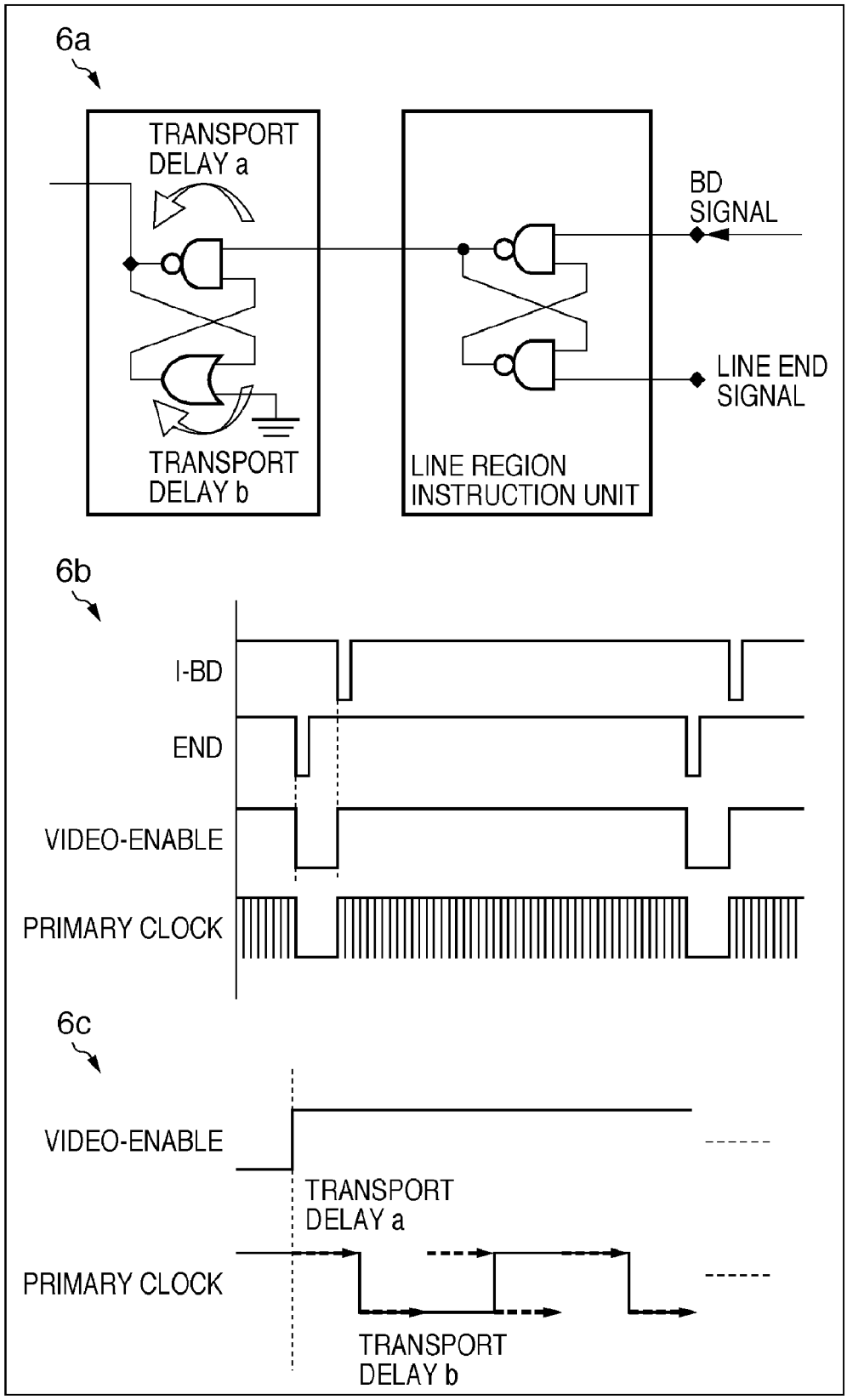
FIG. 6 is a diagram illustrating operations performed by a horizontal synchronization high-frequency clock generation unit 20.

FIG. 6 is a diagram illustrating an example of an operational timing, used to illustrate the characteristics of the DLL circuit, which in turn clearly illustrates the frequency stabilizing correction unit for the primary clock according to the present embodiment.

"6*a*" in FIG. 6 illustrates a specific example of the transport delay oscillator circuit unit 21 within the horizontal synchronization high-frequency clock generation unit 20 that generates the primary clock based on a video enable signal that indicates a permissible range of a video signal outputted from the line region instruction unit 10. Note that the video enable signal is expressed by the term "Video-Enable" in "6*b*" in FIG. 6.

As indicated by "6*b*" in FIG. 6, when the video enable signal changes to enable (in "6*b*" in FIG. 6, the region in which the Video-Enable is high-level), the transport delay oscillator circuit unit 21 commences multi-vibrator oscillation in synchronization with the rising edge of the BD signal.

Furthermore, when the video enable signal changes to disable (in "6*b*" in FIG. 6, the region in which the Video-Enable is low-level), the transport delay oscillator circuit unit 21 stops the oscillation operation. This oscillation frequency is generated as indicated by "6*c*" of FIG. 6, during a signal transport repetition of a transport delay a, which is the amount of time required for signal transport by a NAND gate circuit, and a transport delay b, which is the amount of time required for signal transport by an OR gate circuit, as illustrated in "6*a*" of FIG. 6. This transport delay time is determined by the form of the circuit used to configure the gate circuit, the size of the voltage applied to the base transistor that configures the IC, stray capacitance, and so on; this is publicly-known and therefore shall not be shown in the diagrams. Note that while heat is a factor in this transport delay time, with the scanning optical system in the present device, with respect to the effect of heat on the relative position skew between lines, the scale of the time difference is so different due to an extremely low amount of time for scanning in a signal line and the thermal fluctuation that the influence of heat is not a problem, and thus discussions thereof shall be omitted. In the present embodiment, the transport delay oscillator circuit unit 21 is configured as indicated by "6*a*" of FIG. 6. The frequency of the primary clock that is oscillated and outputted is determined in accordance with the voltage supplied to the transport delay oscillator circuit unit 21, resulting in multi-vibrator oscillation being repeated with the transport delay a and the transport delay b, as indicated in "6*c*" of FIG. 6.

Figure 7:
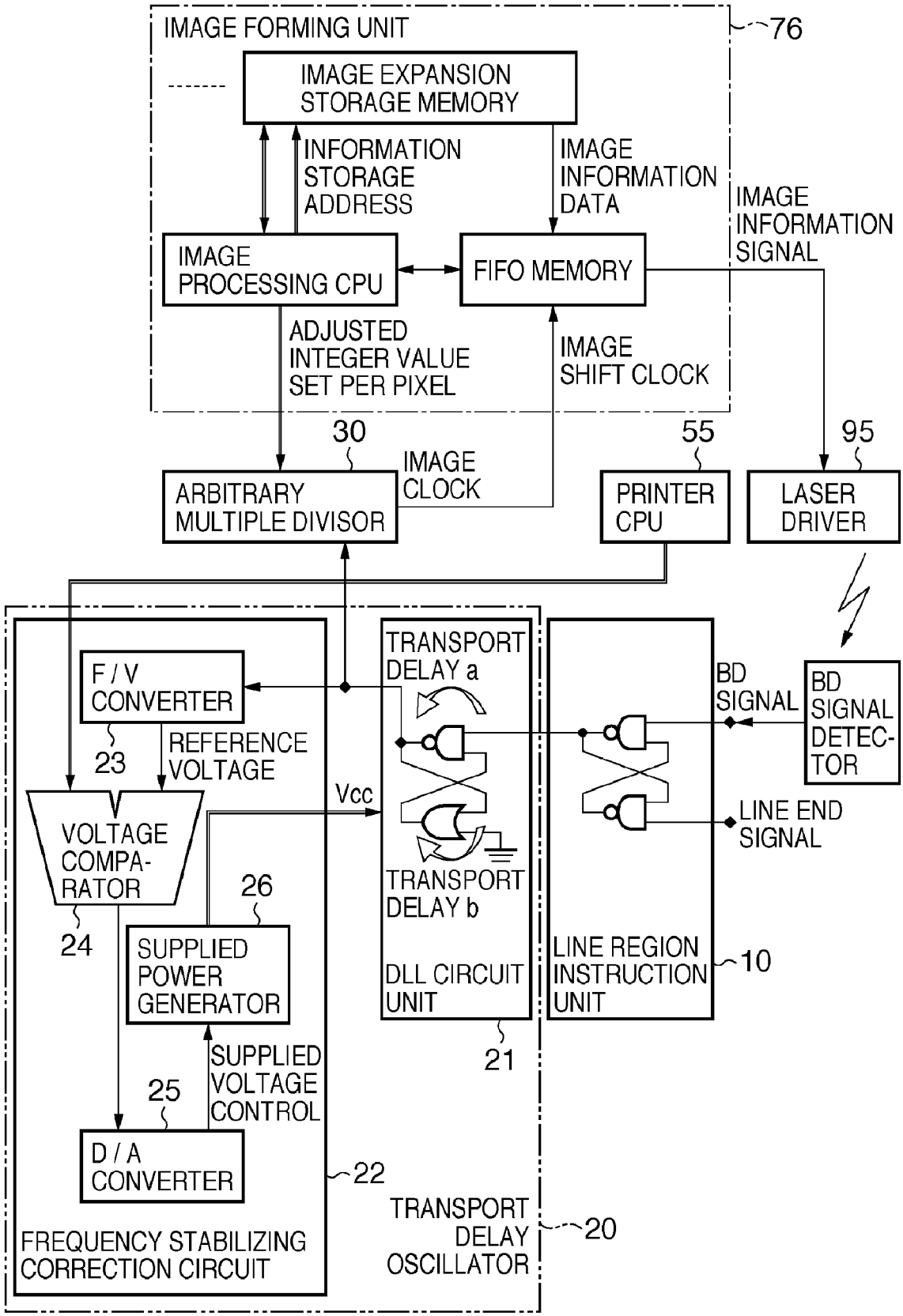
FIG. 7 is a diagram illustrating an exemplary configuration of a horizontal synchronization high-frequency clock generation unit according to a second embodiment of the present invention.

Next, the frequency stabilizing correction unit for the primary clock shall be described with reference to FIG. 7. FIG. 7 is a diagram illustrating an example of another configuration of the previously mentioned horizontal synchronization high-frequency clock generation unit 20; this unit essentially uses a general digital multi-vibrator circuit as indicated in "2*a*" of FIG. 2.

The horizontal synchronization high-frequency clock generation unit 20 is configured of the aforementioned transport delay oscillator circuit unit 21 and a frequency stabilizing correction circuit 22. As described above, it is a goal to detect the frequency of the primary clock outputted from the transport delay oscillator circuit unit 21 in real-time, and perform correction control in analog on voltage supplied to the transport delay oscillator circuit unit 21. The method for achieving this goal is not limited to use of the frequency stabilizing correction circuit 22 illustrated in FIG. 7. That is, a cycle's worth of time of the frequency of the primary clock outputted from the transport delay oscillator circuit unit 21 is converted into a voltage value by a frequency-voltage conversion circuit 23. A voltage comparator 24 compares a reference voltage value, equivalent to the value of a set frequency of the primary clock determined in advance, with the converted voltage, in real-time. Note that although particular descriptions shall not be given regarding the reference voltage value in the present embodiment, it may be set by the CPU 55, and the CPU 55 may be configured so as to be able to perform control for correcting the voltage in accordance with the environment and status of the device or based on image forming correction.

The voltage comparator 24 digitally determines whether the frequency of the primary clock is high or low, and outputs the resultant per stage as an analog voltage value to a supplied power generator 26. As a result, the supplied power generator 26 supplies a desired voltage value to the transport delay oscillator circuit unit 21. The frequency stabilizing correction circuit 22 described in the present embodiment does not directly correct the frequency to the set frequency value all at once, but rather determines whether the frequency is higher or lower than the set frequency value at the time of detection. Then, based on this determination frequency stabilizing correction circuit 22 then executes what is known as restriction correction control that continuously changes the voltage value, using the desired value set for the supplied voltage value as a single step. Through this, sudden extreme changes in the frequency of the primary clock is suppressed, and fluctuation in the image clock to the degree of hundreds to tens of times that of the primary clock is gradually lessened, thereby achieving correction control designed to make positional correction for image forming unnoticeable to the human eye.

Effects of Second Embodiment

As described thus far, configuring the horizontal synchronization high-frequency clock generation unit 20 with the transport delay oscillator circuit unit 21 and the frequency stabilizing correction circuit 22 as described in the present embodiment makes it possible to solve the problem of selecting (making minute adjustments) on the desired value for the frequency of the primary clock of the DLL circuit. The frequency value of the oscillated clock does not need to be adjusted when the device is shipped, and can rather be handled automatically with single overall process.

As a result, a primary clock having a stable frequency value that can be minutely adjusted by the CPU 55 is outputted from the horizontal synchronization high-frequency clock generation unit 20 to the arbitrary multiple divisor 30. The image clock outputted from the arbitrary multiple divisor 30 reflects the correction data, and by executing image formation based on this image clock, synchronization skew arising between lines can be eliminated, making a more favorable image formation possible.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-119617 filed Apr. 27, 2007, and Japanese Patent Application No. 2008-109544 filed Apr. 18, 2008, which are hereby incorporated by reference herein in their entirety.

What is claimed is:

1. An image forming apparatus including a reference clock output unit that outputs a reference clock, an image clock generation unit that divides the outputted reference clock by a set multiple and generates an image clock based on the division, and a synchronization signal detection unit that detects a synchronization signal for synchronizing the timing of the start of optical scanning by a laser beam, the image forming apparatus irradiating the laser beam based on the synchronization signal detected by the synchronization signal detection unit and the image clock generated by the image clock generation unit, and comprising:

a detection unit configured to detect a width of the synchronization signal detected by the synchronization signal detection unit from when the signal goes to active to when the signal returns to non-active; and a correction unit configured to correct the multiple based on the width of the synchronization signal as detected by the detection unit in the optical scanning whose line is the same as the optical scanning line in which the width of the synchronization signal is detected.

2. The image forming apparatus according to claim 1, further comprising:

a calculation unit configured to calculate a fluctuation in the scanning speed of the laser beam, based on the results of the detection performed by the detection unit, wherein the correction unit corrects the multiple based on the fluctuation in the scanning speed of the laser beam found by the calculation unit.

3. The image forming apparatus according to claim 1, further comprising:

a synchronization signal input unit configured to receive an input of the synchronization signal, wherein the reference clock output unit outputs the reference clock in accordance with the input of the synchronization signal into the synchronization signal input unit.

4. The image forming apparatus according to claim 1, wherein the width from when the synchronization signal goes to active to when the signal returns to non-active is determined based on the number of the reference clock during an interval from when the synchronization signal goes to active to when the synchronization signal returns to non-active.

5. The image forming apparatus according to claim 1, wherein the multiple is an integer value.

6. The image forming apparatus according to claim 1, wherein the laser beam is irradiated onto to a photosensitive member.

7. The image forming apparatus according to claim 6, further comprising:

a developing unit configured to develop an electrostatic latent image formed on the photosensitive member by the scanned laser beam into a toner image;

a transfer unit configured to transfer the developed toner image onto a sheet; and a fixing unit configured to fix the transferred toner image on the sheet.

8. An image forming apparatus including a reference clock output unit that outputs a reference clock, an image clock generation unit that generates an image clock, and a synchronization signal detection unit that detects a synchronization signal for synchronizing the timing of the start of optical scanning by a laser beam, the image forming apparatus irradiating the laser beam based on the synchronization signal detected by the synchronization signal detection unit and the image clock generated by the image clock generation unit, and comprising:

a detection unit configured to detect a width of the synchronization signal detected by the synchronization signal detection unit from when the signal goes to active to when the signal returns to non-active; and a correction unit configured to correct a frequency of the image clock based on the width of the synchronization signal as detected by the detection unit in the optical scanning whose line is the same as the optical scanning line in which the width of the synchronization signal is detected.

* * * * *